United States Patent [19]

Wabersich et al.

[11] 4,410,999

[45] Oct. 18, 1983

[54] METHOD AND APPARATUS FOR COOLING A WALL REGION OF A METALLURGICAL FURNACE, IN PARTICULAR AN ELECTRIC ARC FURNACE

[75] Inventors: Ernst Wabersich, Rheinberg; Gerhard Sanders, Baden, both of Fed. Rep. of Germany

[73] Assignee: Korf and Fuchs Systemtechnik, Fed. Rep. of Germany

[21] Appl. No.: 280,122

[22] Filed: Jul. 2, 1981

[30] Foreign Application Priority Data

Jul. 19, 1980 [DE] Fed. Rep. of Germany ..... 3027464

[51] Int. Cl.[3] ..... F27D 1/12

[52] U.S. Cl. ..... 373/76; 122/6 A; 165/170; 432/238

[58] Field of Search ..... 373/76, 75, 74, 73; 122/6 A; 432/238; 165/168, 169, 170, 171

[56] References Cited

U.S. PATENT DOCUMENTS

| | | | |
|---|---|---|---|
| 3,612,501 | 10/1971 | Berczynski et al. | 373/76 |
| 3,692,103 | 9/1972 | Andoniev et al. | 373/76 |
| 3,777,043 | 12/1973 | O'Neill | 373/76 |
| 4,161,620 | 7/1979 | Nakamura | 373/76 |

*Primary Examiner*—Roy N. Envall, Jr.

[57] ABSTRACT

Method and apparatus for evaporation cooling in metallurgical furnaces. In order to prevent the formation of heat-insulating layers of vapor, over a large area, between the heat exchange surface (14) and the cooling fluid supplied thereto, the cooling fluid is supplied at a plurality of positions which are distributed over the surface, and the amount of fluid supplied is so restricted that a closed film of fluid covering the entire heat exchange surface (14) can no longer be formed. The fluid is guided to the heat exchange surface (14) by fluid guide means which are in the form of pin members or plates, or by way of a loose filling of particles, which communicate with the heat exchange surface (14) (FIG. 2).

17 Claims, 16 Drawing Figures

Figure 4:
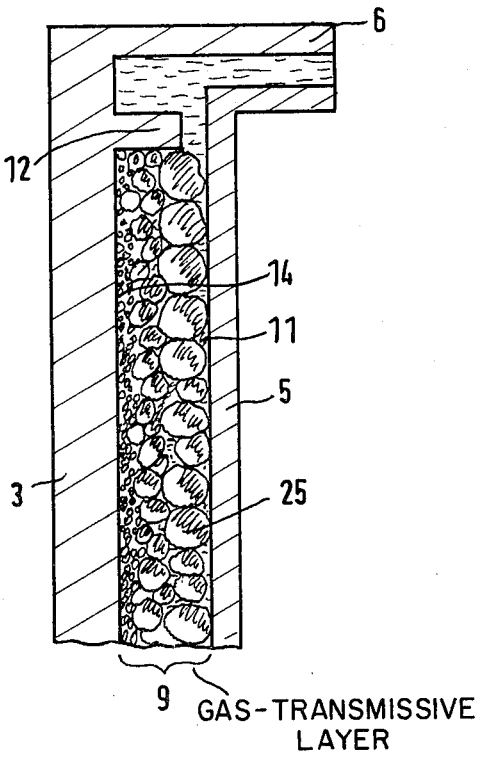

FIG. 1
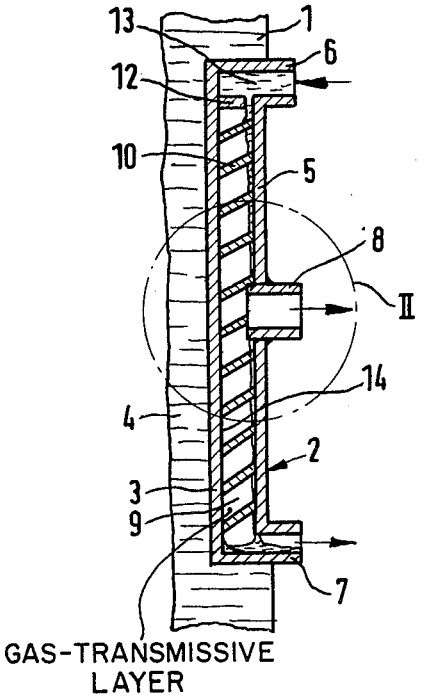
FIG. 2
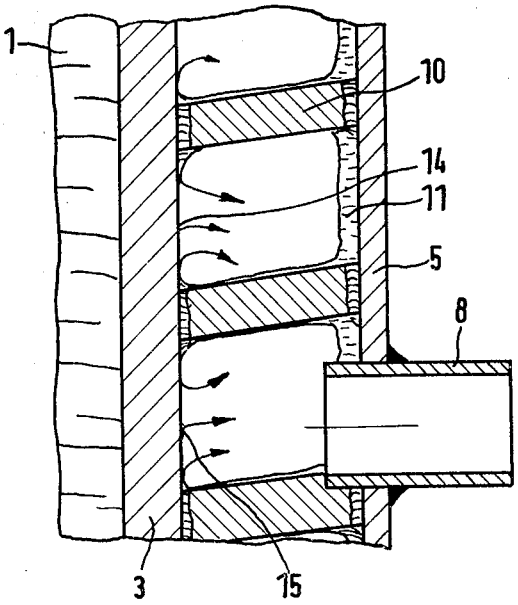
FIG. 3a
FIG. 3b
FIG. 3c
FIG. 3d
FIG. 3e
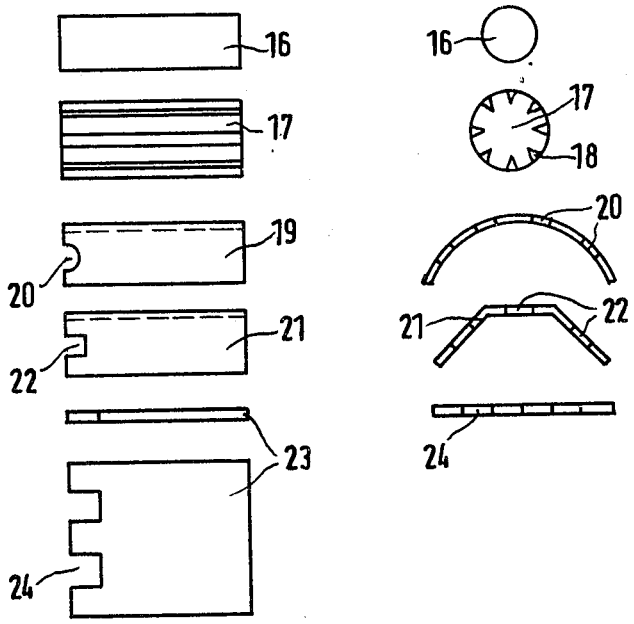

METHOD AND APPARATUS FOR COOLING A WALL REGION OF A METALLURGICAL FURNACE, IN PARTICULAR AN ELECTRIC ARC FURNACE

In regard to cooling a wall region, which has a high thermal loading, of a metallurgical furnace, in particular an electric arc furnace, wherein the wall has a thermal loading which fluctuates widely in respect of time and position, there is the problem of preventing film boiling, that is to say, the occurrence of thin layers of vapour or boundary layers at the heat exchange surface, as such layers have greatly reduced thermal conductivity, and an unstable condition arises, so that the heat exchange is reduced at that point and damage due to local overheating can occur in the case of water cooling boxes which themselves form the furnace wall. In order to prevent film boiling, it is conventional for the flow speed of the coolant to be increased in the region of the heat exchange surface. In the case of the cooling arrangement in accordance with DAS No 1 108 372, this is achieved by the cooling fluid being supplied to the heat exchange surface by way of a plurality of nozzles which are disposed closely above that surface. In the metallurgical furnace in accordance with DOS No 27 22 681, the high flow speed which prevents evaporation of the cooling fluid is achieved by reducing the flow cross-section of the flow passage.

If, due to a high flow speed, the temperature at the heat exchange surface is kept down to such a low value that no boiling phenomenon can occur even at a position which is subjected to a high thermal loading, then the consumption of coolant is very high, in open cooling systems, while in closed systems large pumping, cooling and treatment apparatuses are required.

The amount of fluid required for cooling can be considerably reduced if the liquid is caused to evaporate and thus evaporation enthalpy can be utilized for cooling purposes.

If a cooling liquid trickles down a wall surface to be cooled, then, when there is an increase in thermal loading, the result is three ranges with increasing heat transfer, namely convection boiling, bubble boiling and film boiling. In this connection, bubble boiling is of particular significance because a very good level of heat transfer is achieved. Convection boiling is still comparatively uneconomical, while with film boiling, when using water as the cooling fluid, there is an unstable area between about 120° and 800° C., which involves the danger of local overheating.

German patent specification No 972 023 discloses a door cooling frame with circulatory evaporation cooling of higher pressure stages for Siemens-Martin furnaces and other industrial furnaces, wherein vertically disposed web plates are welded into the middle portion of the door cooling frame, the web plates on the one hand imparting the required strength to the middle portion and on the other hand providing for guiding the vapour-water mixture which is formed. The cooling water is introduced through supply conduits and nozzles into the individual chambers formed by the web plates, and the vapour-water mixture which is formed is discharged again from the upwardly open chambers, along the web plates. In this arrangement, the boiling process takes place essentially in the range of convection boiling, so that this process is still comparatively uneconomical.

The problem of the present invention, is to achieve good cooling over the entire heat exchange surface, in spite of severe fluctuations in respect of time and place in the level of thermal loading, making use of evaporation enthalpy. The invention seeks reliably to prevent the formation of a film of vapour over a large area, that is to say, a film boiling phenomenon which results in inadmissibly high local thermal loading on the heat exchange wall, in spite of the fluctuations in thermal loading in respect of time and place.

In the solution according to the invention, the cooling liquid is supplied to the heat exchange surface by way of elements (fluid guide means) which carry the liquid, at a plurality of positions which are distributed over the heat exchange surface. In this arrangement, the supply of liquid is restricted to such an amount that a closed film of liquid can no longer be formed on the heat exchange surface, or is even more reduced so that film-like regions of liquid, which are separated from each other, are formed around the supply positions. In the last-mentioned case, all the coolant which is supplied to the heat exchange surface is evaporated, while in the other situation there is a small residual amount of water which can be utilized as a control parameter for metering the cooling fluid. This makes it possible to employ pressure-less evaporation cooling, without the danger of local overheating as a result of formation of a film of vapour over a large area.

Figure 5:
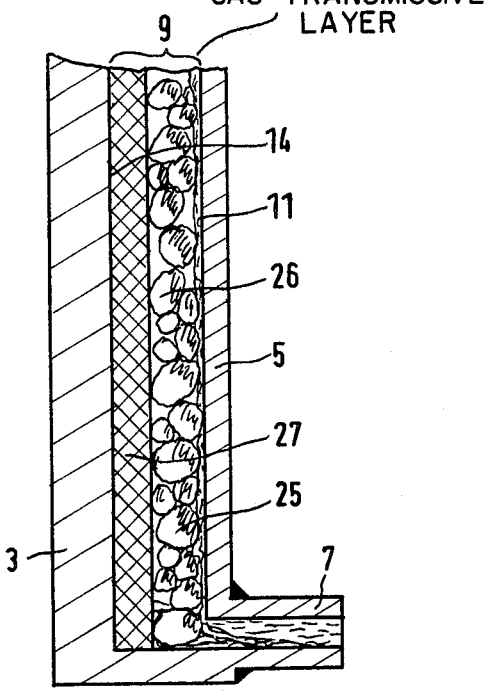
Figure 6:
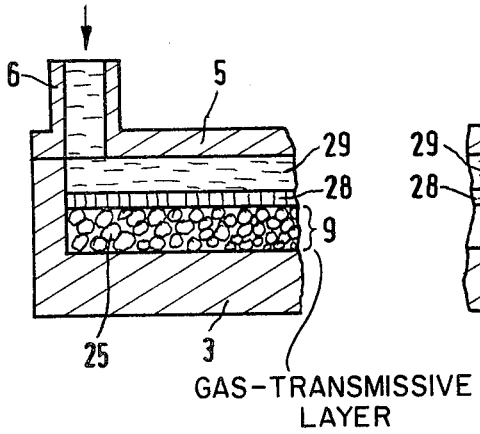
Figure 7:
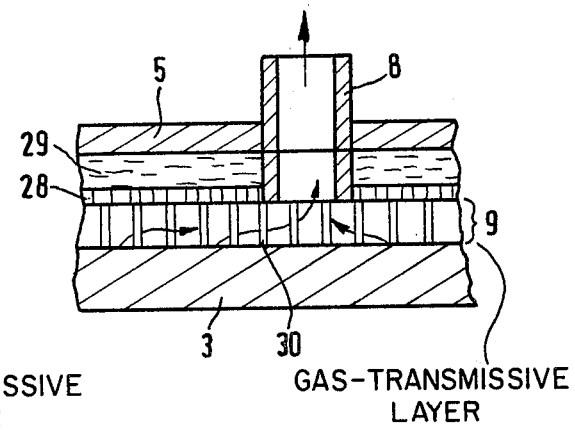
Figure 8:
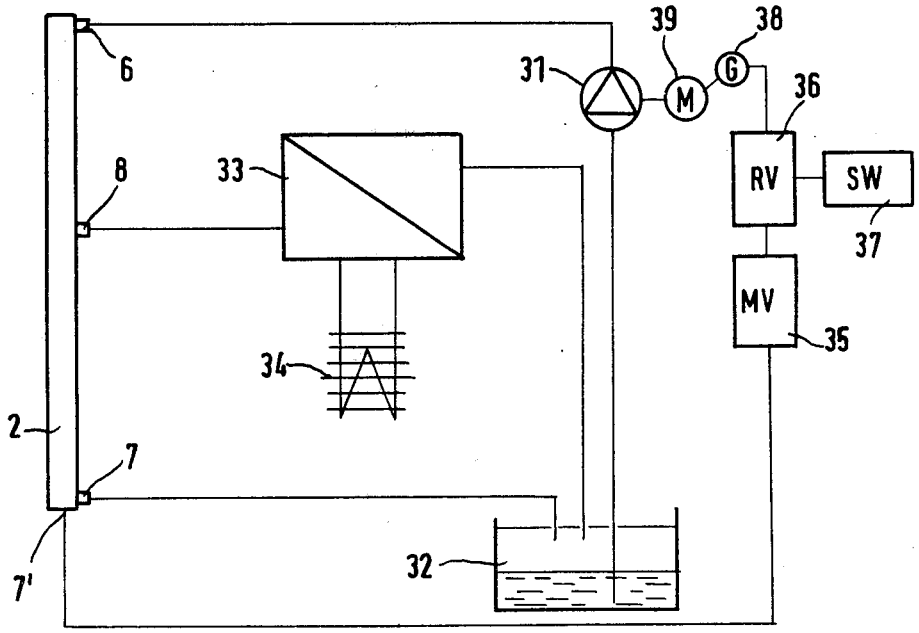
Figure 9:
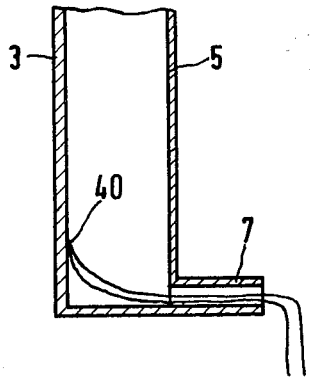
Figure 10:
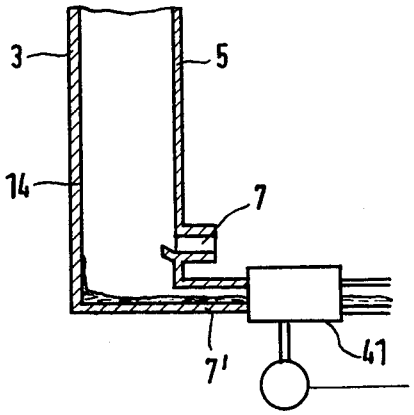
Figure 11:
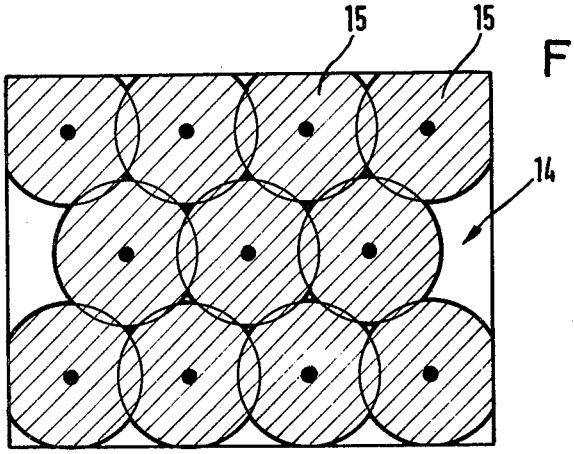
Figure 12:
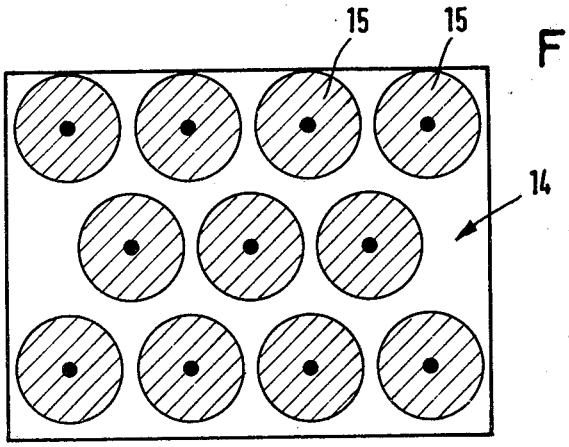

The invention is described in greater detail hereinafter by means of embodiments with reference to twelve Figures of drawings in which:

FIG. 1 shows a cooling box which is fitted into the side wall of a metallurgical furnace, in accordance with the invention, FIG. 2 shows the portion II of the cooling box of FIG. 1, on an enlarged scale, FIGS. 3*a* to 3*e* two different views of various forms of the liquid guide members, FIG. 4 shows a view in cross-section of the upper part of a further embodiment of a cooling box, FIG. 5 shows a view in cross-section of the lower part of a further embodiment, FIGS. 6 and 7 show parts of two cooling boxes which can be fitted in a horizontal position, FIG. 8 shows a principle of a liquid circuit with control in respect to the liquid supply, FIG. 9 shows a part of a cooling box with a temperature sensor, FIG. 10 shows a part of a cooling box with a sender for measuring the discharge flow of cooling liquid, and FIGS. 11 and 12 diagrammatically show the form of the film-like liquid regions on the heat exchange surface.

FIG. 1 shows a side view in cross-section of a cooling box 2 which is fitted into the side wall 1 of a metallurgical furnace, which in the present case is an electric arc furnace. It will be assumed that the cooling box is disposed at one of the so-called hot spots of the arc furnace, that is to say, at one of the points which is directly opposite one of the arcs.

The cooling box 2 includes a heat exchange plate 3 for cooling the adjoining refractory lining 4, a rear wall 5 which is disposed opposite the heat exchange plate, an upper supply dust or conduit 6 and a lower discharge duct or conduit 7 for the cooling liquid, as well as a vapour discharge means 8 which is disposed approximately at the centre of the wall 5. Preferably, the cooling box is a welded steel plate structure. Provided between the wall 5 and the heat exchange plate 3 is a gas-transmissive layer 9 comprising a plurality of elements 10 for transporting the fluid, referred to hereinafter as liquid guide members. The liquid guide members communicate with the heat exchange plate 3 at a plurality of positions which are distributed over the inside surface thereof, referred to hereinafter as the heat exchange surface. The manner of supplying the cooling liquid into the cooling box is such that a layer 11 of liquid (see FIG. 2) of limited thickness is formed on the inside of the wall 5. For this purpose, the arrangement has a partitioning wall 12 which forms a gap with respect to the inside surface of the wall 5 and which forms a storage chamber 13 for the cooling fluid; the cooling fluid can pass into the cooling box from the chamber 13 by way of the above-mentioned gap, and can flow down along the inside surface of the wall 5.

In the present case, the liquid guide members 10 are in the form of connecting members between the rear wall 5 of the cooling box and the heat exchange surface as indicated at 14. The liquid guide members 10 are inclined downwardly towards the heat exchange surface 14. In this way, as can be seen in particular from the enlarged view in FIG. 2 of part of the FIG. 1 arrangement, a small amount of liquid from the liquid layer 11 is conducted by way of each of the liquid guide members 10 to the heat exchange surface 14 where the liquid forms film-like regions 15, which extend outwardly to a greater or lesser degree, around the positions at which the liquid guide members are connected to the heat exchange surface. The liquid boils and evaporates in the regions 15. The number of liquid supply points distributed over the heat exchange surface 14 is so selected that, with sufficient cooling, no film of vapour over a large area can be formed. The layer 9 of guide members is vapour-transmissive. The vapour produced leaves the cooling box by way of the vapour discharage means 8.

In the described embodiment, the fluid is conveyed by way of the liquid guide members 10, by the force of gravity. The liquid guide members 10 are arranged at an inclined angle, for that purpose. It is also possible to make use of other forces, for example capilliary forces, for transportation of the liquid.

FIGS. 3*a* to 3*c* show a side view and a plan view of various forms of fluid guide members 10. FIG. 3*a* shows a liquid guide member in the form of a pin member 16. FIG. 3*b* shows a liquid guide member in the form of a pin member 17 with longitudinal grooves 18 acting as capilliary means, distributed around the periphery of the pin member 17. FIG. 3*c* shows a bent metal plate member 19, the convex side of which faces upwardly and which is provided with through-flow openings 20 at the end connected to the heat exchange surface 14. FIG. 3*d* shows a plate member 21 which is bent into a trapezoidal configuration, with through-flow openings 22, while FIG. 3*e* shows three different views of a flat plate member 23 with openings 24 at the end adjoining the heat exchange surface 14. The liquid guide members shown in FIGS. 3*a* to 3*e* are to be used such that the liquid fed at one end can flow along the guide members all the way to the other end. With the exception of the guide member of FIG. 3*b*, in which capillary forces are used for the advancement of the liquid, all of the guide members are disposed slopingly, like the guide members 10 of FIG. 2. They can also be disposed vertically like the guide members 30 shown in FIG. 7. The guide members of FIG. 3*d* can also be disposed horizontally.

In the embodiments illustrated in FIGS. 4 to 6, the layer 9 comprises a loose filling of particles or an open-pore foam or sintered material. The embodiment shown in FIG. 4 uses a granulate 25 of ceramic material, glass or fine gravel or grit, which is introduced successively in portions in accordance with grain size in such a way that the size of the particles decreases towards the heat exchange surface 14. In this way, particles of coarse grain size adjoin the inside surface of the rear wall 5 of the cooling box, and permit the cooling liquid to flow relatively unhinderedly over the entire rear wall 5, and the liquid is gradually conducted by way of finer and finer particles, to the heat exchange surface 14. The layer 9 of liquid guide elements thus comprises a plurality of layers of particles of different particle sizes.

In the embodiment shown in FIG. 5, the layer 9 of liquid guide elements is formed from a coarse-grain granulate 26 and an open-pore foam or sintered material 27 which performs the function of the fine-grain material of the layer 9 in the embodiment shown in FIG. 4. It will be appreciated that both the fine-grain material and also the open-pore foam or sintered material must be gas-transmissive so that the gases formed by evaporation of the cooling liquid at the heat exchange surface 14 can be drawn off by way of the vapour discharge means 8.

While, in the embodiment described hereinbefore, the heat exchange plate 3 is arranged vertically, which is usually the situation when the cooling box is fitted into the side wall of a metallurgical furnace or forms a part of the furnace side wall, FIGS. 6 and 7 show embodiments with a horizontal heat exchange plate 3, that is to say, the situation in which the cooling box is fitted into the cover of the furnace or forms a part of the furnace cover. In this case it is necessary for a distributor layer 28 to be provided between the layer 9 and the rear wall 5 of the cooling box, for distributing the cooling fluid to the layer 9, and supplying it in a metered fashion. In the embodiments shown in FIGS. 6 and 7, the distributor layer 28 is in the form of a porous intermediate wall which sucks up cooling liquid and passes it in a distributed and metered manner to the layer 9. Disposed above the porous intermediate wall 28 is a storage chamber 29 for the cooling liquid. As the porous intermediate wall, which is full with cooling fluid, is not gas-transmissive, the vapour discharge means 8 must be extended through the intermediate wall, as shown in FIG. 7. In other respects, FIGS. 6 and 7 differ in that the embodiment of FIG. 6 uses a liquid guide layer comprising a granulate while the embodiment of FIG. 7 uses a guide layer 9 of pin-shaped liquid guide members 30 which are provided between the distributor layer 28 and the heat exchange plate 3.

FIG. 8 shows an embodiment of a liquid circuit for supplying a cooling box 2 with cooling liquid. The cooling fluid is supplied to the supply line or conduit 6 and to the cooling box 2, by a pump 31, from a fluid tank or reservoir 32. The evaporated liquid leaves the cooling box at the vapour discharge means 8 and passes into a heat exchanger 33 for making further use of the thermal energy. This is indicated by a heating means 34. Because of the high temperature in comparison with the conventional fluid cooling systems, other forms of energy recovery are also possible, for example by heating water for industrial use or by connecting in an ORC-process.

The condensed vapour flows from the heat exchanger 33 into the receiving tank 32. For the purposes of controlling the supply flow of cooling liquid, the temperature of the heat exchange plate of the cooling box or the amount of overflow or excess water which flows off the heat exchange surface is measured, and the measurement value is applied by way of a measuring amplifier 35 to a control amplifier 36. the desired reference value is inputted into the amplifier 36 by a reference value generator 37. The control amplifier 36 controls a tachogenerator 38 which switches the motor 39 of the pump 31 on or off, depending on the respective reference value of the reference value generator 37.

FIG. 9 shows the mode of detecting the temperature of the heat exchange plate 3 by means of a thermocouple 40, while FIG. 10 shows measurement of the amount of overflow or excess water which flows off the heat exchange surface 14, by a flow measuring means 41. The amount of liquid flowing down on the inside surface of the rear wall 5 must be guided past the flow measuring means 41.

Although various liquids with a high degree of evaporation enthalpy, such as fluorinated hydrocarbons, for example Frigen R 114 are suitable as the cooling liquid, water is preferably used as the cooling fluid, for reasons of economy.

FIG. 11 is a diagrammatic view of the manner of formation of the film-like regions 15 of fluid on the heat exchange surface 14, in the situation where the amount of fluid supplied at the liquid supply positions, as indicated by points, is so severely restricted that it is no longer possible for a closed film of fluid which covers the entire heat exchange surface to be formed. In spite of this, under the operating conditions shown in FIG. 11, the individual regions 15 of liquid are still in contact with each other.

In the situation diagrammatically illustrated in FIG. 12, the supply of liquid is so severely restricted that the regions 15 of fluid which are formed on the heat exchange surface can no longer overlap or touch each other, thus resulting in the formation of film-like regions 15 of liquid, which are separated from each other.

We claim:

1. A cooling box to be fitted into a wall region of a metallurgical furnace or to form said wall region, the cooling box comprising a heat exchange plate, a rear wall disposed opposite the heat exchange plate, a supply conduit and a discharge conduit for cooling liquid, a vapour discharge means, a vapour-transmissive layer between the rear wall and the heat exchange plate having a plurality of liquid guide means for supplying liquid to the heat exchange plate, and means for defining an area of a layer of liquid on the inside surface of the rear wall, said liquid guide means being in communication with the heat exchange plate at a plurality of positions distributed over the inside surface thereof and with said area of the layer of liquid on the inside surface of the rear wall when feeding a limited amount of liquid into said supply conduit.

2. A cooling box according to claim 1, wherein there is provided a storage chamber for cooling liquid adjoining the inside surface of the rear wall which is delimited by a distributor layer with which the liquid guide means communicates.

3. A cooling box according to claim 2, wherein the distributor layer is formed as a porous partioning wall.

4. A cooling box according to claim 2 or 3 wherein the liquid guide means extends between said distributor layer and the heat exchange plate.

5. A cooling box according to claim 1, wherein the liquid guide means are inclined downwardly towards the heat exchange plate.

6. A cooling box according to claim 1, wherein the liquid guide means are provided with capillary means.

7. A cooling box according to any one of claims 1, 2 or 5, wherein at least a part of the liquid guide means is of a pin-like configuration.

8. A cooling box according to claim 1 or 5, wherein at least a part of the liquid guide means is of a plate-like configuration.

9. A cooling box according to claim 26, wherein the plate-like liquid guide means is of a curved or bent cross-section.

10. A cooling box according to any one of claims 1, 2 or 3, wherein the liquid guide means is formed from a loose filling of particles.

11. A cooling box according to claim 10, wherein the particle size of said liquid guide means decreases towards the heat exchange plate.

12. A cooling box according to claim 10, wherein at least a part of said liquid guide means comprises granulate materials, sand or pumice.

13. A cooling box according to claim 10, wherein at least part of said liquid guide means comprises rings.

14. A cooling box according to claim 1, wherein at least part of the liquid guide means is formed from an open-pore foam or sintered material.

15. Apparatus comprising a cooling box to be fitted into a wall region of a metallurgical furnace or to form said wall region, the cooling box comprising a heat exchange plate, a rear wall disposed opposite the heat exchange plate, a supply conduit and a discharage conduit for cooling liquid, a vapour discharge means, a vapour-transmissive layer between the rear wall and the heat exchange plate having a plurality of liquid guide means for supplying liquid to the heat exchange plate, means for defining an area of a layer of liquid on the inside surface of the rear wall, said liquid guide means being in communication with the heat exchange plate at a plurality of positions distributed over the inside surface thereof and with said area of the layer of liquid on the inside surface of the rear wall when feeding a limited amount of liquid into said supply conduit, a liquid tank, conduit means for connecting the liquid tank via a pump with the supply conduit and with the discharge conduit respectively, and control means for controlling the supply flow of cooling liquid delivered by the pump in dependence on the amount of fluid which runs off the heat exchange plate as excess liquid, to such an amount that film-like regions which are formed around supply positions on the heat exchange plate can no longer form a closed film of liquid which covers the entire heat exchange plate.

16. Apparatus comprising a cooling box to be fitted into a wall region of a metallurgical furnace or to form said wall region, the cooling box comprising a heat exchange plate, a rear wall disposed opposite the heat exchange plate, a supply conduit and a discharge conduit for cooling liquid, a vapour discharge means, a vapour-transmissive layer between the rear wall and the heat exchange plate having a plurality of liquid guide means for supplying liquid to the heat exchange plate, means for defining an area of a layer of liquid on the inside surface of the rear wall, said liquid guide means being in communication with the heat exchange plate at a plurality of positions distributed over the inside surface thereof and with said area of the layer of liquid on the inside surface of the rear wall when feeding a limited amount of liquid into said supply conduit, a liquid tank, conduit means for connecting the liquid tank via a pump with the supply conduit and with the discharge conduit, respectively, and control means for controlling the supply flow of cooling liquid delivered by the pump in dependence on temperature measurement values which are detected by a temperature sensing means on the heat exchange plate to such an amount that film-like regions of liquid which are formed around supply positions on the heat exchange plate can no longer form a closed film of liquid which covers the entire heat exchange plate.

17. Apparatus according to claim 15 or 16, wherein the supply of cooling liquid is limited to such an amount that film-like regions of fluid which are separated from each other are formed on the heat exchange plate around the cooling liquid supply positions.

* * * * *